US008531380B2

(12) United States Patent
Feng

(10) Patent No.: US 8,531,380 B2
(45) Date of Patent: Sep. 10, 2013

(54) METHODS AND SYSTEMS FOR AREA ADAPTIVE BACKLIGHT MANAGEMENT

(75) Inventor: Xiao-Fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 755 days.

(21) Appl. No.: 12/177,758

(22) Filed: Jul. 22, 2008

(65) Prior Publication Data

US 2010/0020003 A1 Jan. 28, 2010

(51) Int. Cl.
*G09G 3/36* (2006.01)

(52) U.S. Cl.
USPC ..... 345/102; 345/87; 345/89; 345/93; 345/95; 345/100

(58) Field of Classification Search
USPC ..... 345/87–102, 644, 690, 691, 420; 340/438, 602; 250/208.1, 234; 362/29, 235, 362/244, 259, 330
See application file for complete search history.

(56) References Cited

U.S. PATENT DOCUMENTS

| | | | | |
|---|---|---|---|---|
| 5,978,142 | A | 11/1999 | Blackham et al. | |
| 6,268,843 | B1 | 7/2001 | Arakawa | |
| 6,992,279 | B2 * | 1/2006 | Okuwaki et al. | 250/234 |
| 7,312,779 | B1 * | 12/2007 | Blevins | 345/102 |
| 7,525,528 | B2 * | 4/2009 | Feng | 345/87 |
| 7,635,200 | B2 * | 12/2009 | Atsushi | 362/244 |
| 7,737,930 | B2 * | 6/2010 | Inuzuka et al. | 345/87 |
| 7,762,470 | B2 * | 7/2010 | Finn et al. | 235/492 |
| 2002/0021292 | A1 | 2/2002 | Sakashita | |
| 2002/0050987 | A1 | 5/2002 | Sakashita | |
| 2004/0095558 | A1 | 5/2004 | Whitehead et al. | |
| 2005/0007781 | A1 * | 1/2005 | Okuwaki et al. | 362/259 |
| 2005/0206511 | A1 * | 9/2005 | Heenan et al. | 340/438 |
| 2006/0103621 | A1 * | 5/2006 | Feng | 345/102 |
| 2006/0125771 | A1 * | 6/2006 | Inuzuka et al. | 345/102 |
| 2006/0202945 | A1 * | 9/2006 | Feng | 345/102 |
| 2006/0291185 | A1 * | 12/2006 | Atsushi | 362/29 |
| 2007/0285382 | A1 * | 12/2007 | Feng | 345/102 |
| 2007/0296886 | A1 * | 12/2007 | Inada et al. | 349/61 |
| 2008/0129677 | A1 * | 6/2008 | Li et al. | 345/102 |
| 2008/0150880 | A1 * | 6/2008 | Inuzuka et al. | 345/102 |
| 2009/0015720 | A1 * | 1/2009 | Yamamoto | 348/607 |
| 2009/0174638 | A1 * | 7/2009 | Brown Elliott et al. | 345/88 |
| 2009/0251401 | A1 * | 10/2009 | Gorog | 345/102 |
| 2009/0295706 | A1 * | 12/2009 | Feng | 345/102 |
| 2010/0277515 | A1 * | 11/2010 | Ward et al. | 345/690 |

FOREIGN PATENT DOCUMENTS

| | | | |
|---|---|---|---|
| JP | 200851905 | A | 3/2008 |
| JP | 200870558 | A | 3/2008 |
| JP | 2008051905 | A | 3/2008 |
| JP | 2008070558 | A | 3/2008 |
| WO | WO03077013 | | 9/2003 |

OTHER PUBLICATIONS

International Search Report for PCT/JP2009/063450 dated Nov. 2, 2009 claiming priority to the present application.

(Continued)

*Primary Examiner* — Prabodh M Dharia
(74) *Attorney, Agent, or Firm* — David C. Ripma

(57) ABSTRACT

Elements of the present invention relate to systems and methods for generating, modifying and applying backlight array driving values.

20 Claims, 7 Drawing Sheets

(56) References Cited

OTHER PUBLICATIONS

H. Seetzen, W. Heidrich, W. Stuerzlinger, G. Ward, L. Whitehead, M. Trentacoste, A. Ghosh, and A. Vorozcovs, High Dynamic Range Display Systems, ACM SIGGRAPH 2004.

European Search Report for PCT/JP2009053450 dated Sep. 20, 2011 claiming priority ot the present application.

Japanese Patent Grant for corresponding application—JP 2011-501839, Oct. 12, 2012.

Chinese Office Action for corresponding application—CN 20090128332.5, Jun. 18, 2008.

* cited by examiner

PSF

| | | | | | | |
|---|---|---|---|---|---|---|
| 0.04 | 0.08 | 0.14 | 0.19 | 0.14 | 0.08 | 0.04 |
| 0.06 | 0.15 | 0.40 | 0.61 | 0.40 | 0.15 | 0.06 |
| 0.07 | 0.20 | 0.62 | 1.00 | 0.62 | 0.20 | 0.07 |
| 0.06 | 0.15 | 0.40 | 0.61 | 0.40 | 0.15 | 0.06 |
| 0.04 | 0.08 | 0.14 | 0.19 | 0.14 | 0.08 | 0.04 |

67

METHODS AND SYSTEMS FOR AREA ADAPTIVE BACKLIGHT MANAGEMENT

FIELD OF THE INVENTION

Embodiments of the present invention comprise methods and systems for generating, modifying and applying backlight driving values for an LED backlight array.

BACKGROUND

Some displays, such as LCD displays, have backlight arrays with individual elements that can be individually addressed and modulated. The displayed image characteristics can be improved by systematically addressing backlight array elements.

SUMMARY

Some embodiments of the present invention comprise methods and systems for generating, modifying and applying backlight driving values for an LED backlight array.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF EXEMPLARY EMBODIMENTS

Figure 1:
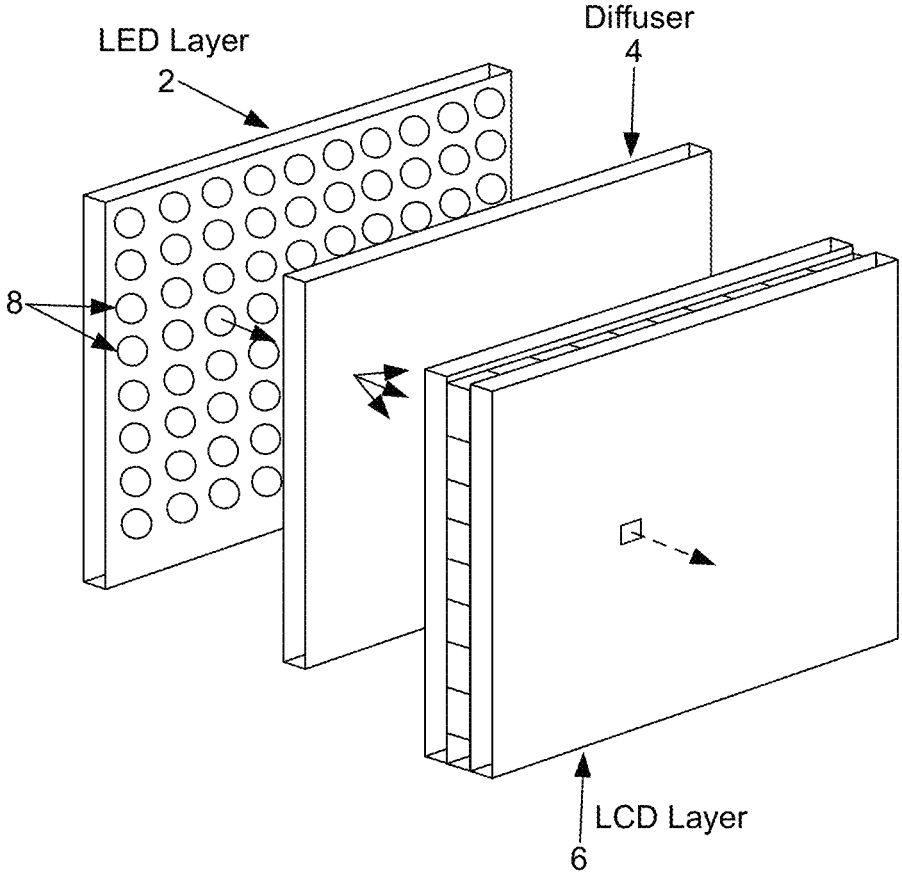
FIG. 1 is a diagram showing a typical LCD display with an LED backlight array.

Embodiments of the present invention will be best understood by reference to the drawings, wherein like parts are designated by like numerals throughout. The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the methods and systems of the present invention is not intended to limit the scope of the invention but it is merely representative of the presently preferred embodiments of the invention.

Elements of embodiments of the present invention may be embodied in hardware, firmware and/or software. While exemplary embodiments revealed herein may only describe one of these forms, it is to be understood that one skilled in the art would be able to effectuate these elements in any of these forms while resting within the scope of the present invention.

In a high dynamic range (HDR) display, comprising an LCD using an LED backlight, an algorithm may be used to convert the input image into a low resolution LED image, for modulating the backlight LED, and a high resolution LCD image. To achieve high contrast and save power, the backlight should contain as much contrast as possible. The higher contrast backlight image combined with the high resolution LCD image can produce much higher dynamic range image than a display using prior art methods. However, one issue with a high contrast backlight is motion-induced flickering. As a moving object crosses the LED boundaries, there is an abrupt change in the backlight: In this process, some LEDs reduce their light output and some increase their output; which causes the corresponding LCD to change rapidly to compensate for this abrupt change in the backlight. Due to the timing difference between the LED driving and LCD driving, or an error in compensation, fluctuation in the display output may occur causing noticeable flickering along the moving objects. The current solution is to use infinite impulse response (IIR) filtering to smooth the temporal transition, however, this is not accurate and also may cause highlight clipping.

An LCD has limited dynamic range due the extinction ratio of polarizers and imperfections in the LC material. In order to display high-dynamic-range images, a low resolution LED backlight system may be used to modulate the light that feeds into the LCD. By the combination of modulated LED backlight and LCD, a very high dynamic range (HDR) display can be achieved. For cost reasons, the LED typically has a much lower spatial resolution than the LCD. Due to the lower resolution LED, the HDR display, based on this technology, can not display high dynamic pattern of high spatial resolution. But, it can display an image with both very bright areas (>2000 cd/m$^2$) and very dark areas (<0.5 cd/m$^2$) simultaneously. Because the human eye has limited dynamic range in a local area, this is not a significant problem in normal use. And, with visual masking, the eye can hardly perceive the limited dynamic range of high spatial frequency content.

Another problem with modulated-LED-backlight LCDs is flickering along the motion trajectory, i.e. the fluctuation of display output. This can be due to the mismatch in LCD and LED temporal response as well as errors in the LED point spread function (PSF). Some embodiments may comprise temporal low-pass filtering to reduce the flickering artifact.

Some embodiments of the present invention may be described with reference to FIG. 1, which shows a schematic of an HDR display with an LED layer 2, comprising individual LEDs 8 in an array, as a backlight for an LCD layer 6. The light from the array of LEDs 2 passes through a diffusion layer 4 and illuminates the LCD layer 6.

In some embodiments, the backlight image is given by $$bl(x,y)=LED(i,j)*psf(x,y) \quad (1)$$

where LED(i,j) is the LED output level of each individual LED in the backlight array, psf(x,y) is the point spread function of the diffusion layer and * denotes a convolution operation. The backlight image may be further modulated by the LCD.

The displayed image is the product of the LED backlight and the transmittance of the LCD: $T_{LCD}(x,y)$.

$$img(x,y)=bl(x,y)T_{LCD}(x,y)=(led(i,j)*psf(x,y))T_{LCD}(x,y) \quad (2)$$

By combining the LED and LCD, the dynamic range of the display is the product of the dynamic range of LED and LCD. For simplicity, in some embodiments, we use a normalized LCD and LED output between 0 and 1.

Figure 2:
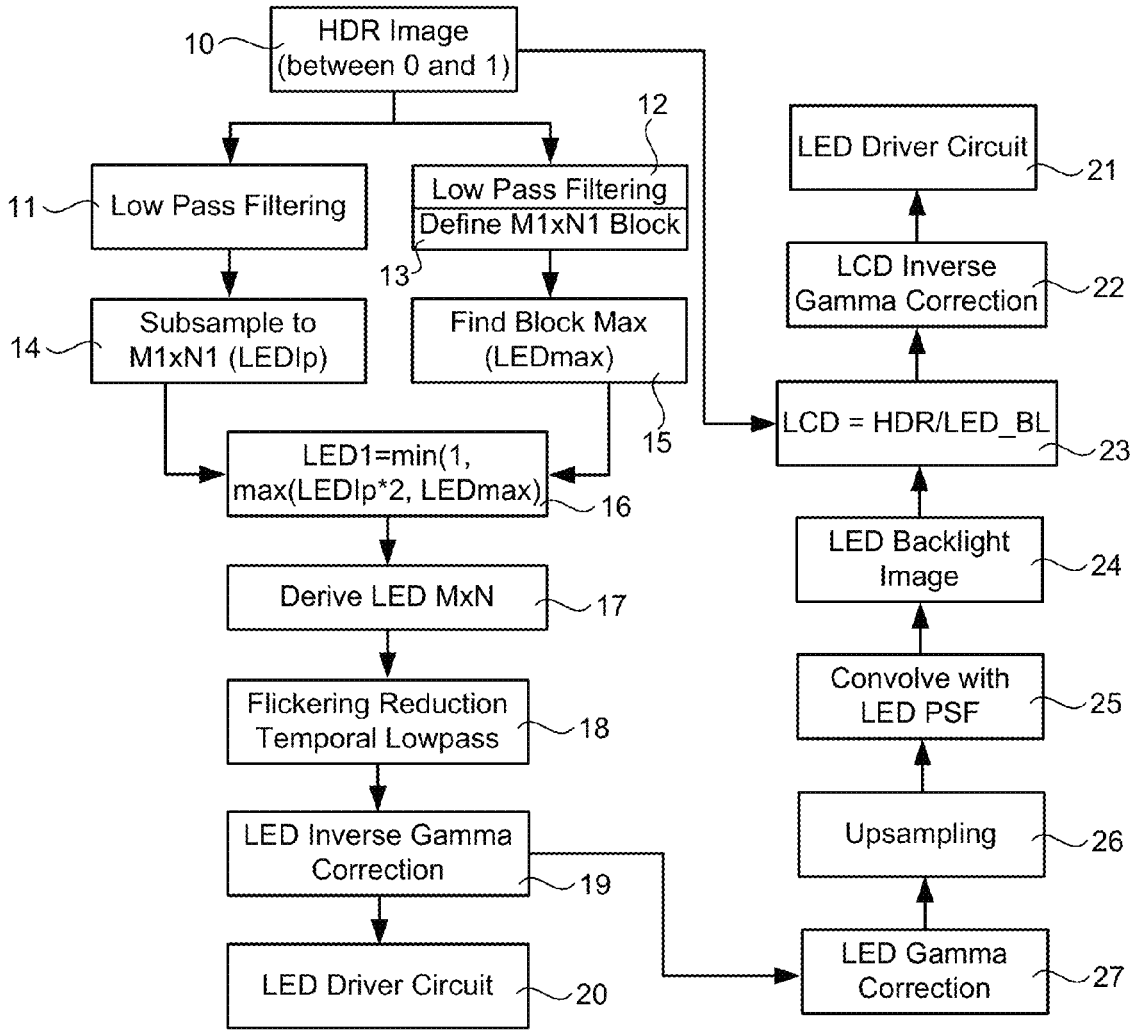
FIG. 2 is a chart showing an exemplary embodiment of the present invention comprising determination of LED backlight driving values.

Some exemplary embodiments of the present invention may be described with reference to FIG. 2, which shows a flowchart for an algorithm to convert an input image into a low-resolution LED backlight image and a high-resolution LCD image. The LCD resolution is m×n pixels with its range from 0 to 1, with 0 representing black and 1 representing the maximum transmittance. The LED resolution is M×N with M<m and N<n. We assume that the input image has the same resolution as the LCD image. If the input image is a different resolution, a scaling or cropping step may be used to convert the input image to the LCD image resolution. In some embodiments, the input image may be normalized 10 to values between 0 and 1.

In these embodiments, the input image may be low-pass filtered 11 using the point spread function of the diffusion screen of the display to create an LPF image. This LPF image may then be sub-sampled 14 to an intermediate resolution. In some embodiments, the intermediate resolution will be a multiple of the LED array size (aM×aN). In an exemplary embodiment, the intermediate resolution may be 2 times the LED resolution (2M×2N). In some embodiments, the extra resolution may be used to reduce flickering. This subsampled image may be referred to as an LEDlp image.

The HDR input image 10 may also be low pass filtered 12 with a smaller filter kernel, such as a 5×5 kernel, to simulate the size of a specular pattern. This smaller low-pass filtered image (SLPF image) may then be divided 13 into aM×aN blocks with each block corresponding to one LED with some overlap between each block. For example, in an exemplary embodiment, the block size may be (1+k)*(m/M×n/N), where k is the overlap factor. In an exemplary embodiment, k may be set to 0.25. A maximum value may then be determined 15 for each block. These maximum block values may be used to form an LEDmax image with a resolution of M×N.

In some embodiments, a combined LED1 image may be created 16 by selecting between variations of the LEDmax image and the LEDlp image. In an exemplary embodiment, the LED1 image may be determined by selecting the greater of two times the LEDlp image and the LEDmax image as expressed in the following equation:

$$LED1=\max(LEDlp\times 2, LED\max). \quad (3)$$

In some embodiments, the values in the LED1 image may be constrained to be less than one, for example, through the use of equation 4:

$$LED1=\min(\max(LEDlp\times 2, LED\max), 1). \quad (4)$$

By taking into account the local maximum, the specular highlight is preserved. Also, using twice the LED1 image values ensures that the maximum LCD operating range will be used. These embodiments better accommodate images with high dynamic range and high spatial frequency.

The resulting LED1 image will have a size of M×N and a range from 0 to 1. Since the PSF of the diffusion screen is larger than the LED spacing to provide for a more uniform backlight image, there is considerable crosstalk between the LED elements that are located close together.

Figure 3:
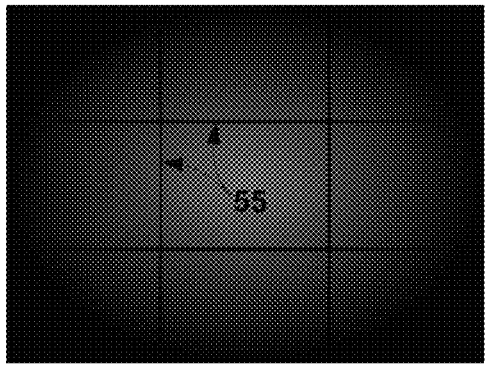
FIG. 3 is an image illustrating an exemplary LED point spread function.
Figure 4:
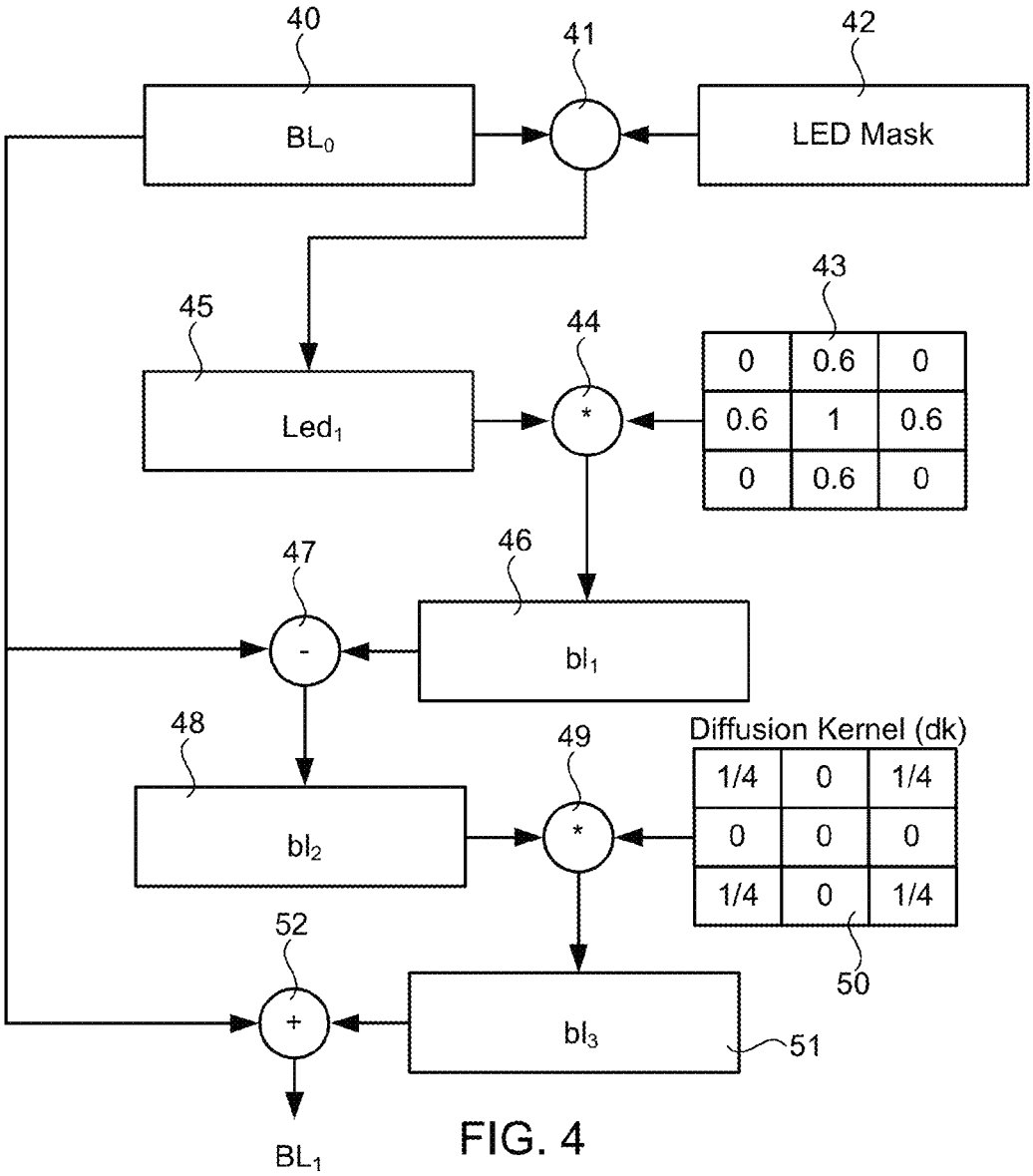
FIG. 4 is a chart showing an exemplary pre-processing algorithm.

FIG. 3 shows a typical LED PSF where the black lines 55 within the central circle of illumination indicate the borders between LED array elements. From FIG. 3, it is apparent that the PSF extends beyond the border of the LED element.

Because of the PSF of the LEDs, any LED has contribution from each of its neighboring LEDs. Although Equation 2 can be used to calculate the backlight, given an LED driving signal, deriving the LED driving signal to achieve a target backlight image is an inverse problem. This is an ill-posed de-convolution problem. In one approach, a convolution kernel is used to derive the LED driving signal as shown in Equation 5. The crosstalk correction kernel coefficients ($c_1$ and $c_2$) are negative to compensate for the crosstalk from neighboring LEDs.

$$\text{crosstalk} = \begin{vmatrix} c_2 & c_1 & c_2 \\ c_1 & c_0 & c_1 \\ c_2 & c_1 & c_2 \end{vmatrix} \quad (5)$$

The crosstalk correction matrix does reduce the crosstalk effect from its immediate neighbors, but the resulting backlight image is still inaccurate with a too-low contrast. Another problem is that it produces many out of range driving values that have to be truncated and can result in more errors.

Since the LCD output can not be more than 1, the LED driving value must be derived 17 so that backlight is larger than target luminance, e.g., $$led(i,j):\{led(i,j)*psf(x,y)\geqq I(x,y)\} \quad (6)$$

In Equation 6, ":" is used to denote the constraint to achieve the desired LED values of the function in the curly bracket. Because of the limited contrast ratio (CR), due to leakage, LCD(x,y) can no longer reach 0. The solution is that when a target value is smaller than LCD leakage, the led value may be reduced to reproduce the dark luminance.

$$led(i,j):\{led(i,j)\otimes psf(x,y)<I(x,y)\cdot CR\} \quad (7)$$

In some embodiments, another goal may be a reduction in power consumption so that the total LED output is reduced or minimized.

$$led(i,j):\left\{\min\sum_{i,j} led(i,j)\right\} \quad (8)$$

Flickering may be due to the non-stationary response of the LED combined with the mismatch between the LCD and LED. The mismatch can be either spatial or temporal. Flickering can be reduced or minimized 18 by reducing the total and localized led output fluctuation between frames.

$$led(i,j):\left\{\min\left(\sum_{i,j} led(i,j)-\sum_{i,j} led(i-x_0, j-y_0)\right)\right\} \quad (9)$$

where $x_0$ and $y_0$ define the distance from the center of the LED. To achieve Equation 9, a series of non-LED grid points or virtual points are introduced to minimize the LED output fluctuation. In some embodiments, one or more virtual points are inserted between two LEDs. Without the virtual point, when an object (bright) moves from one LED to another LED, the first LED decreases and the second LED increases. This occurs suddenly and causes flickering. With the virtual point, the bright object first moves to the virtual point, and then to the second LED. The virtual point causes the first LED to slowly reduce its output and the second LED to increase its output. In some embodiments, the flickering can be further reduced by temporal IIR filtering. Combining Equations 6 and 9 yields Equation 10 below.

$$led(i,j):\left\{\begin{array}{l} led(i,j)*psf(x,y)\geq I(x,y) \\ led(i,j)*psf(x,y)<I(x,y)\cdot CR \\ \min\sum_{i,j} led(i,j) \\ \min\left(\sum_{i,j} led(i,j)-\sum_{i,j} led(i-x_0,j-y_0)\right) \end{array}\right\} \quad (10)$$

In some embodiments, the algorithm to derive 17 the backlight driving values that satisfy Eq. 10, or other constraints, comprises the following steps:

1. Pre-processing: Distribute the non-LED virtual point to its neighbor. Virtual points are those points with desired backlight values but without an LED (off-grid).
2. Multiple pass routine to derive the LED driving values with a constraint that led >0.
3. Post-processing: for those LEDs with a driving value more than 1 (maximum), threshold to 1 and then use anisotropic error diffusion to distribute the error to its neighboring LEDs.

Figure 5:
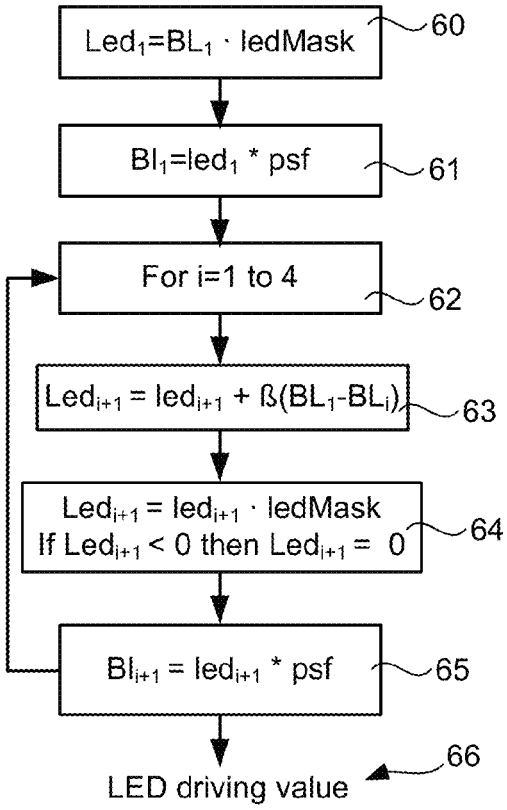
FIG. 5 is a chart showing an exemplary method for deriving LED driving values.

FIG. 5 shows an exemplary pre-processing algorithm. The LED target image ($BL_0$) is derived for both LED points and virtual points. In this example, the target image consists of two point types: one located on an LED grid, and the other a virtual (off-grid) point.

1. The first step is to set the initial LED driving value 40 the same as the target value, $BL_0$, 40. LedMask 42 is 1 if it is an LED grid point and 0 for a virtual point. In some embodiments, the initial LED driving value 45, led0, may be the dot product of the backlight target value, $BL_0$, 40 and the LEDMask, 42

$$led_0=BL_0\cdot LEDmask$$

2. The backlight (bl) may be approximated with a convolution 44 of LED driving value 45, $led_0$, with a truncated PSF ($psf_2$) kernel (e.g., 3×3) 43.

$$bl_1=led_0*psf_2.$$

3. The deficiency, $bl_2$, of the backlight may be determined as $$bl_2=\max(0,BL_0-bl_1).$$

4. To compensate for this deficiency, the led driving values of it 4 neighbors may be increased by a deficiency adjustment, $bl_3$, determined by $$bl_3=k\ bl_2*dk,$$

where k is a constant to compensate for the lower crosstalk value from the LED point to the virtual point and dk is the diffusion matrix. These two terms can be combined in practice.

5. A modified target value, $BL_1$, may then be determined by adding 52 the deficiency adjustment to the initial target value 40 by $$BL_1=(BL_0+bl_3).$$

Finding an LED driving value from a target value is an ill-posed problem that requires an iterative algorithm, which is computationally expensive and difficult to implement in hardware. Some aspects of embodiments of the present invention may be described with reference to FIG. 5. In these embodiments, a multi-pass algorithm may be used to derive (some embodiments may comprise part of step 17 of FIG. 2) an LED driving value 66. In some embodiments, the LED driving value may be initialized 60 with a revised target value ($BL_1$) from a pre-processing step, as explained above.

In an iterative approach, the backlight may be calculated by multiplying an LED driving value, e.g., a 1D vector of length MN, where MN is the total number of LEDs, with the crosstalk matrix (MN×MN). This is very computationally expensive and not necessary since the crosstalk between LEDs that far apart is very small.

In some exemplary embodiments, the backlight may be approximated 61 by convolving the LED driving value, $Led_1$, with a truncated PSF 67 of size 7×5. In some embodiments, an iterative method may then be used 62 for a fixed number of iterations. In an exemplary embodiment, four iterations provide good results. A new LED driving value, $Led_{i+1}$ may be increased or decreased 63 by the scaled difference between a target value and a predicted value. The scale factor may be 0.28 in an exemplary embodiment and may vary based on the PSF and other factors.

In some embodiments, the intermediate LED driving value, $Led_{i+1}$, may then be multiplied by the ledMask and the result may be constrained 64 to be greater than 0 and to be found only on those LED grid points defined by ledMask. The constrained intermediate LED driving value may then be convolved 65 with the truncated PSF 67. The process may repeat for a few iterations to achieve the desired LED driving value 66 and will typically converge after about 4 iterations.

Figure 6:
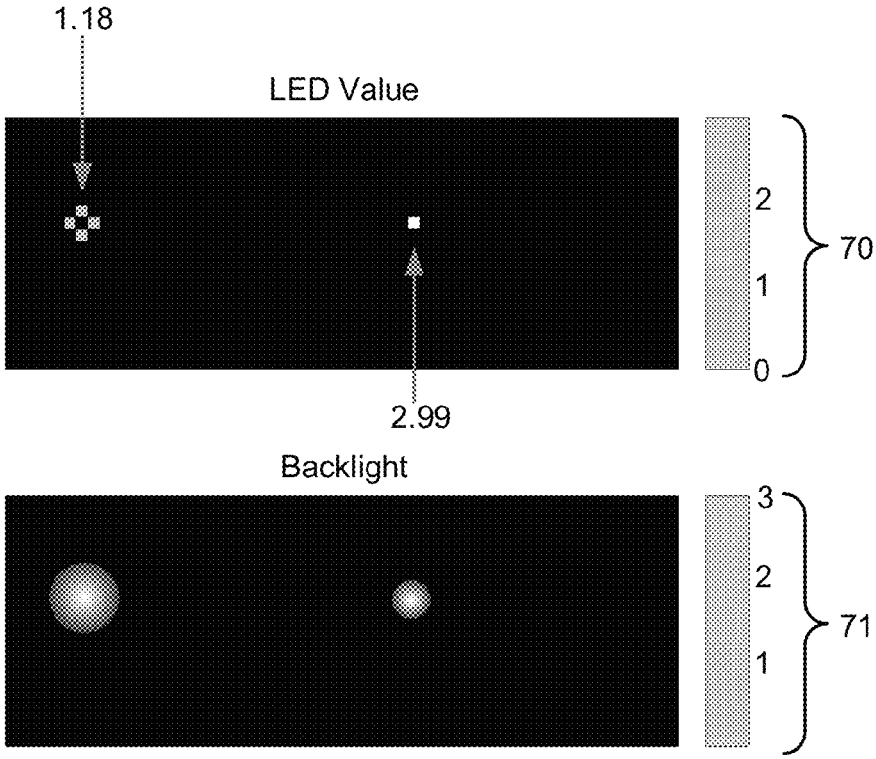
FIG. 6 is set of images showing exemplary LED backlight driving values and corresponding responses after error diffusion.

Aspects of some embodiments of the present invention may be described with reference to FIG. 6, which shows a derived LED driving value 70 and the predicted backlight value 71. In an exemplary embodiment, in order to achieve a desired backlight value, e.g., 3, an LED driving value of 1.18 is needed for the 4 neighboring LEDs of a virtual point and a driving value of 2.99 is needed for the LED point. As shown in FIG. 6, the derived LED driving value can be larger than 1, but the LED can only be driven to a maximum of 1. In some embodiments, an anisotropic error diffusion post-process may be used to distribute this truncation error to the neighboring LEDs.

Figure 10:
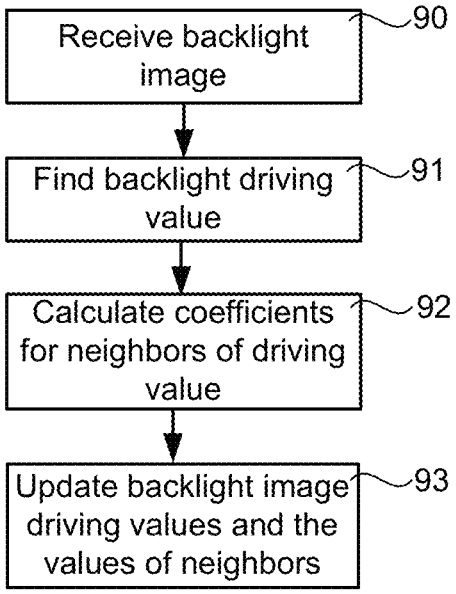
FIG. 10 is a chart showing an exemplary error diffusion post-process.

In an exemplary embodiment, illustrated in FIG. 10, the following steps may be used to accomplish this process on a backlight image 90:

1. Find 91 $led_{i,j} > 1$
2. Calculate 92 the coefficients for its 4 neighbors,
   $C_{i-1,j} = \max(0,1-led_{i-1,j})$
   $C_{i+1,j} = \max(0,1-led_{i+1,j})$
   $C_{i,j-1} = \max(0,1-led_{i,j-1})$
   $C_{i,j+1} = \max(0,1-led_{i,j+1})$
3. Update 93 the LED values,
   $led_{i,j} = 1$
   $led_{i-1,j} = led_{i-1,j} + k(led_{i,j}-1)* C_{i-1,j} / \Sigma(C_{i,j})$
   $led_{i+1,j} = led_{i+1,j} + k(led_{i,j}-1)* C_{i-1,j} / \Sigma(C_{i,j})$
   $led_{i,j-1} = led_{i,j-1} + k(led_{i,j}-1)* C_{i-1,j} / \Sigma(C_{i,j})$
   $led_{i,j+1} = led_{i,j+1} + k(led_{i,j}-1)* C_{i-1,j} / \Sigma(C_{i,j})$ In some embodiments, the steps above may be approximated for hardware implementation with the following:

1. Find $led_{i,j} > 1$;
2. Sorting the 4 neighboring LEDs in ascending order $led_1$ to $led_4$; and
3. If ($led_4 - led_1$ < threshold),
   $led_{i,j} = 1$
   $led_n = led_n + k(led_{i,j}-1)>>2$; n=1,2,3,4

-continued

Figure 7:
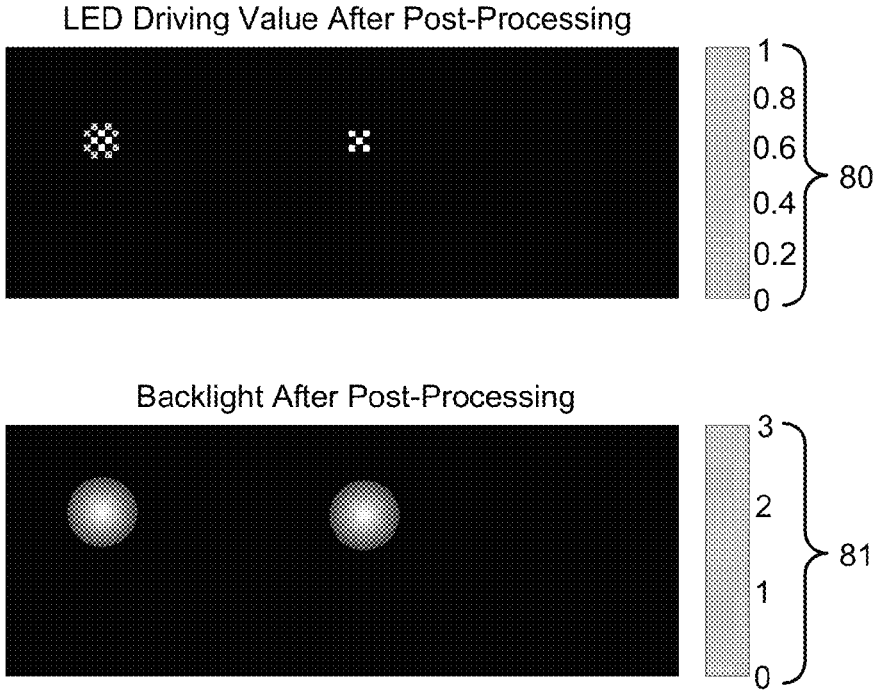
FIG. 7 is set of images showing exemplary LED backlight driving values and corresponding responses after post-processing.

```
else
    led_{i,j} = 1
    led_1 = led_1 + k(led_{i,j}-1)>>3
    led_2 = led_2 + k(led_{i,j}-1)>>2
    led_3 = led_3 + k(led_{i,j}-1)>>2
    led_4 = led_4 + k(led_{i,j}-1)>>1
```

where k>1 is a constant to compensate for the reduced contribution from the neighboring LEDs. In an exemplary embodiment, it is about 25%. In some embodiments, the above anisotropic error diffusion is performed at a larger neighborhood. FIG. 7 illustrates the LED driving value 80 and the predicted backlight 81 after post-processing. The Led driving value is within the physical limit of between 0 and 1 while the backlight is still greater than the target value.

In some embodiments, since the LED output is non-linear with respect to the driving value and the driving value is an integer, inverse gamma correction 19 and quantization may be performed to determine the LED driving value that will be sent to the LED driver circuit 20.

Figure 8:
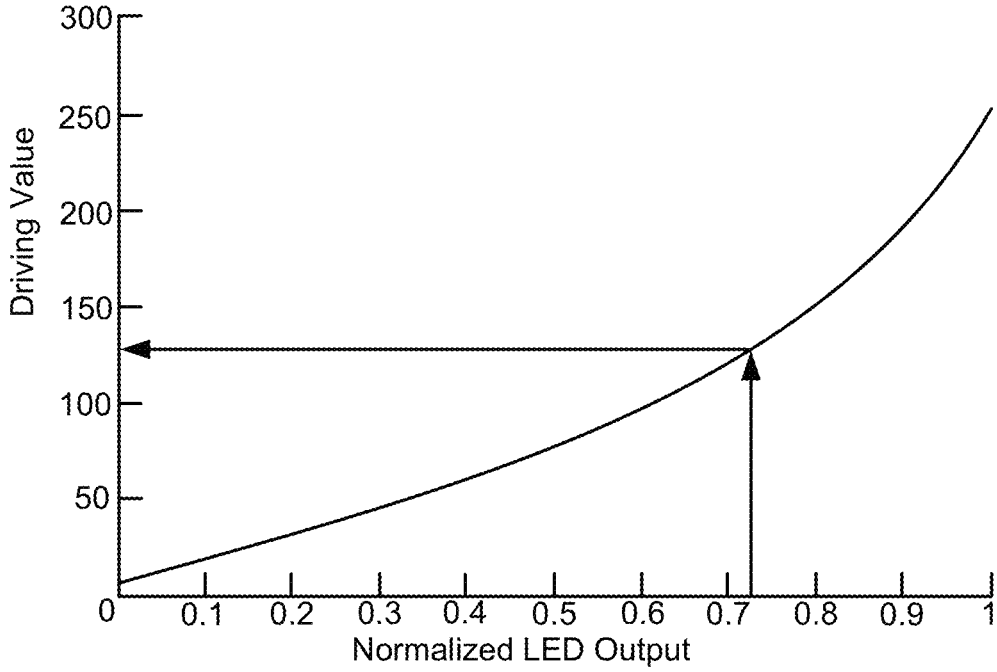
FIG. 8 is a graph showing an exemplary inverse gamma correction curve for an LED backlight image.

FIG. 8 illustrates an exemplary inverse gamma correction process for the LEDs. In the overall process, illustrated in FIG. 2, the quantized driving value is again gamma corrected 27 to yield the actual LED output.

In some embodiments, the backlight image may now be predicted from the LED image. The LED image may be upsampled 26 to the LCD resolution (m×n) and convolved with the PSF of the diffusion screen 25 to yield an LED backlight image 24. The LCD transmittance may be calculated 23 with equation 11.

$$T_{LCD}(x,y)=img(x,y)/bl(x,y) \tag{11}$$

Figure 9:
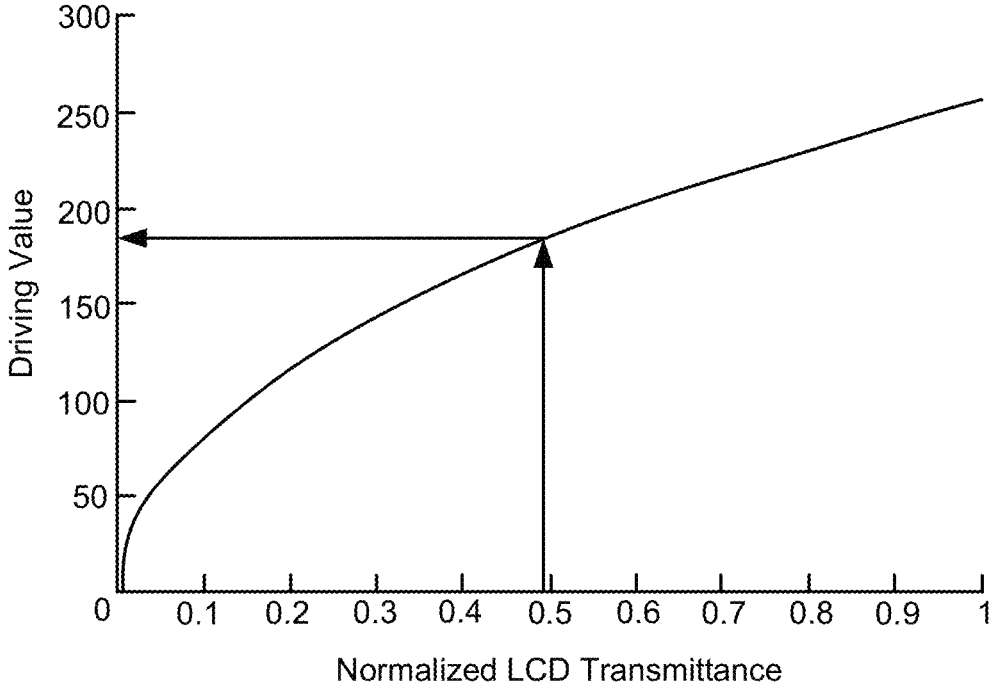
FIG. 9 is a graph showing an exemplary inverse gamma correction curve for an exemplary LCD image.

Again, inverse gamma correction 22 may be performed, to correct for the non-linear response of the LCD and the resulting LCD image may be sent to an LCD driver circuit 21. FIG. 9 shows an exemplary inverse gamma correction curve.

In some embodiments, to reduce the flickering effect, temporal low-pass filtering 18 may be used to smooth sudden temporal fluctuations. Equation 12 describes an exemplary filtering process.

$$led_n(i,j) = \begin{cases} k_{up}f(i,j)+(1-k_{up})led_{n-1}(i,j)_\text{if_f}(i,j) > led_{n-1}(i,j) \\ k_{down}f(i,j)+(1-k_{down})led_{n-1}(i,j)_\text{else} \end{cases} \tag{12}$$

wherein $k_{up}$ is typically chosen to be higher than $k_{down}$ to satisfy Equation 6. In an exemplary embodiment, $k_{up}$ may be set to 0.5 and $k_{down}$ may be set to 0.75.

The terms and expressions which have been employed in the foregoing specification are used therein as terms of description and not of limitation, and there is no intention in the use of such terms and expressions of excluding equivalence of the features shown and described or portions thereof.

I claim:

1. A method for modifying display backlight target values, said method comprising:

a) receiving an initial backlight target value image, $BL_0$;

b) establishing an initial LED driving value ($led_0$) image comprising on-grid LED points and off-grid virtual points located between said on-grid LED points of said initial backlight target value image by convolving said $BL_0$ image with an LED mask comprising said virtual point off-grid locations;

c) determining an approximated backlight image ($bl_1$) by convolving said $led_0$ image with a truncated point spread function ($psf_2$) kernel;

d) determining a backlight deficiency image ($bl_2$), based on a difference between said $BL_0$ image and said $bl_1$ image;

e) creating a compensated backlight image ($bl_3$) by convolving said $bl_2$image with a diffusion kernel; and f) determining a modified LED target value image ($BL_1$) by adding said $bl_3$image to said $BL_0$ image.

2. A method as described in claim 1 wherein said truncated point spread function ($psf_2$) is a 3×3 kernel represented by:

| | | |
|---|---|---|
| 0 | 0.6 | 0 |
| 0.6 | 1 | 0.6 |
| 0 | 0.6 | 0 |

3. A method as described in claim 1 wherein said diffusion kernel is a 3×3 kernel represented by:

| | | |
|---|---|---|
| 0.25 | 0 | 0.25 |
| 0 | 0 | 0 |
| 0.25 | 0 | 0.25 |

4. A method for generating a modified LED target value image for a display backlight array, said method comprising:

a) receiving a target backlight image ($BL_1$);

b) combining said $BL_1$ image with an LED mask, comprising off-grid virtual points interspersed between actual image points, to create an $led_1$ image;

c) convolving said $led_1$ image with a point spread function (PSF) to create an approximated backlight image, $BL_2$;

d) determining a difference image representing the difference between said target backlight image, $BL_1$, and said approximated backlight image, $BL_2$;

e) determining a scaling factor, β;

f) scaling said difference image with said scaling factor thereby creating a scaled difference image;

g) adding said $led_1$ image to said scaled difference image to create a revised LED image, $led_{i+1}$; and h) setting values in said revised, $led_{i+1}$, image to zero when said values are less than zero.

5. A method as described in claim 4 wherein said point spread function is a 5×7 kernel represented by:

| | | | | | | |
|---|---|---|---|---|---|---|
| 0.04 | 0.08 | 0.14 | 0.19 | 0.14 | 0.08 | 0.04 |
| 0.06 | 0.15 | 0.4 | 0.61 | 0.4 | 0.15 | 0.06 |
| 0.07 | 0.2 | 0.62 | 1 | 0.62 | 0.2 | 0.07 |
| 0.06 | 0.15 | 0.4 | 0.61 | 0.4 | 0.15 | 0.06 |
| 0.04 | 0.08 | 0.14 | 0.19 | 0.14 | 0.08 | 0.04 |

6. A method as described in claim 4 further comprising repeating steps d through h a fixed number of times.

7. A method for post-processing backlight image driving values for a display backlight array, said method comprising:

a) receiving a backlight image comprising backlight image driving values in display hardware;

b) finding a backlight image driving value, $led_{i,j}$, in said backlight image, that is greater than one;

c) calculating coefficients for neighbors of said driving value, $led_{i,j}$, with said display hardware using the following equations:

$$C_{i-1,j}=\max(0,1-led_{i-1,j})$$

$$C_{i+1,j}=\max(0,1-led_{i+1,j})$$

$$C_{i,j-1}=\max(0,1-led_{i,j-1})$$

$$C_{i,j+1}=\max(0,1-led_{i,j+1})$$

d) updating said backlight image driving values and the values of said neighbors, with said processor using the following equations:

$$led_{i,j}=1$$

$$led_{i-1,j}=led_{i-1,j}+k(led_{i,j}-1)*C_{i-1,j}/\Sigma(C_{i,j})$$

$$led_{i+1,j}=led_{i+1,j}+k(led_{i,j}-1)*C_{i-1,j}/\Sigma(C_{i,j})$$

$$led_{i,j-1}=led_{i,j-1}+k(led_{i,j}-1)*C_{i-1,j}/\Sigma(C_{i,j})$$

$$led_{i,j+1}=led_{i,j+1}+k(led_{i,j}-1)*C_{i-1,j}/\Sigma(C_{i,j});$$

wherein k is a constant used to compensate for a reduced contribution from neighboring LEDs.

8. A method for generating a backlight image for a display backlight array, said method comprising:

a) receiving an input image comprising an array of pixel values representing an image at an LCD image pixel resolution;

b) low-pass filtering said input image with a point spread function of a display diffusion screen to create a low-pass-filtered (LPF) image;

c) subsampling said LPF image to an intermediate resolution thereby creating a LED 1p image;

d) low-pass filtering said input image with a kernel that is smaller than the kernel used to create said LPF image thereby creating a second low-pass-filtered (SLPF) image;

e) dividing said SLPF image into blocks wherein each block corresponds to a display backlight LED element in said display backlight array with some overlap between array elements;

f) determining a maximum value in each of said blocks of said SLPF image thereby creating LEDmax values in an LEDmax image; and g) creating an LED1 image comprising values based on one of a corresponding LEDmax image value and a corresponding LED 1p image value.

9. A method as described in claim 8 wherein said LED1 image is created by selecting values from said LED1p image and said LEDmax image such that LED1 image values are the greater of the corresponding LEDmax value and the corresponding LED1p value times two.

10. A method as described in claim 8 wherein said intermediate resolution is a multiple of the resolution of said backlight array.

11. A method as described in claim 8 wherein the size of said blocks in said SLPF image is determined with the following equation:

$$(1+k)*(m/M\times n/N)$$

wherein k is an overlap factor, M and N are dimensions of the LED backlight array and m and n are the dimensions of an LCD array.

12. A method as described in claim 8 further comprising:

a) deriving an LED backlight image from said LED1 image; and b) performing inverse gamma correction on said LED image, thereby creating an inverse-gamma-corrected (IGC) LED image for said display backlight array.

13. A method as described in claim 12 further comprising:

a) performing gamma correction on said IGC LED image, thereby creating an LED2 image;

b) upsampling said LED2 image to said LCD resolution;

c) convolving said LED2 image with the point spread function (PSF) of a diffusion layer of said display thereby creating an LED_BL image;

d) dividing said input image by said LED_BL image to create an LCD image; and e) performing inverse gamma correction on said LCD image, thereby creating an inverse-gamma-corrected (IGC) LCD image.

14. A method as described in claim 12 wherein said deriving an LED backlight image comprises:

a) receiving an initial backlight target value image, $BL_0$;

b) establishing an initial LED driving value ($led_0$) image comprising virtual points located between pixel elements of said input image by convolving said $BL_0$ image with an LED mask comprising said virtual point locations;

c) determining an approximated backlight image ($bl_1$) by convolving said $led_0$ image with a truncated point spread function ($psf_2$) kernel;

d) determining a backlight deficiency image ($bl_2$), which based on a difference between said $BL_0$ image and said $bl_1$ image;

e) creating a compensated backlight image ($bl_3$) by convolving said $bl_2$image with a diffusion kernel; and f) determining a modified LED target value image ($BL_1$) by adding said $bl_3$image to said $BL_0$ image.

15. A method as described in claim 12 further comprising performing temporal low-pass filtering on said LED1image.

16. A method for generating a backlight image for a display backlight array, said method comprising:

a) receiving an input image comprising an array of pixel values representing an image at an LCD image pixel resolution;

b) low-pass filtering said input image with a point spread function of a display diffusion screen to create a low-pass-filtered (LPF) image;

c) subsampling said LPF image to an intermediate resolution thereby creating a LED 1p image;

d) low-pass filtering said input image with a kernel that is smaller than the kernel used to create said LPF image thereby creating a second low-pass-filtered (SLPF) image;

e) dividing said SLPF image into blocks wherein each block corresponds to a display backlight LED element in said display backlight array with some overlap between array elements;

f) determining a maximum value in each of said blocks of said SLPF image thereby creating LEDmax values in an LEDmax image;

g) creating an LED1image comprising values based on one of a corresponding LEDmax image value and a corresponding LED 1p image value;

h) establishing a target LED driving value ($led_0$) image comprising virtual off-grid points located between on-grid LED elements of said input image by convolving a target backlight image, $BL_0$, with an LED mask comprising said virtual point locations;

i) determining an approximated backlight image ($bl_1$) by convolving said $led_0$ image with a truncated point spread function ($psf_2$) kernel;

j) determining a backlight deficiency image ($bl_2$), which represents a difference between said $BL_0$ image and said $bl_1$ image;

k) creating a compensated LED driving value image ($bl_3$) by convolving said $bl_2$ image with a diffusion kernel; and l) determining a modified LED target value image ($BL_1$) by adding said $BL_0$ image to said $bl_3$image.

17. A method as described in claim 16 further comprising performing temporal low-pass filtering on said $BL_1$ image.

18. A method as described in claim 16 wherein said $BL_1$ image is created by selecting values from said LED1p image and said LEDmax image such that $BL_1$ image values are the greater of the corresponding LEDmax value and the corresponding LED1p value times two.

19. A method as described in claim 16 wherein said intermediate resolution is a multiple of the resolution of said backlight array.

20. A method as described in claim 16 wherein the size of said blocks in said SLPF image is determined with the following equation:

$$(1+k)*(m/M\times n/N)$$

wherein k is an overlap factor, M and N are dimensions of the LED backlight array and m and n are the dimensions of an LCD array.

* * * * *